US009254047B1

(12) United States Patent
Schermel et al.

(10) Patent No.: US 9,254,047 B1
(45) Date of Patent: Feb. 9, 2016

(54) REINFORCED VINYL AIR MATTRESS

(76) Inventors: William Schermel, Mississauga (CA); Ferdinand Schermel, Port Colbourne (CA)

( * ) Notice: Subject to any disclaimer, the term of this patent is extended or adjusted under 35 U.S.C. 154(b) by 1785 days.

(21) Appl. No.: 11/485,929

(22) Filed: Jul. 14, 2006

(51) Int. Cl.
*A47C 27/08* (2006.01)

(52) U.S. Cl.
CPC ..... *A47C 27/083* (2013.01); *A47C 27/082* (2013.01)

(58) Field of Classification Search
CPC ..... A47C 27/00; A47C 27/08; A47C 27/081; A47C 27/082; A47C 27/083; A47C 27/084
USPC ..... 5/711, 710, 712, 713, 655.3, 706, 932
See application file for complete search history.

(56) References Cited

U.S. PATENT DOCUMENTS

| | | | | | |
|---|---|---|---|---|---|
| 4,025,975 | A * | 5/1977 | Phillips et al. | ..... | 5/686 |
| 4,766,628 | A * | 8/1988 | Walker | ..... | 5/706 |
| 4,890,344 | A * | 1/1990 | Walker | ..... | 5/713 |
| 5,815,865 | A * | 10/1998 | Washburn et al. | ..... | 5/713 |
| 5,991,949 | A * | 11/1999 | Miller et al. | ..... | 5/710 |
| 6,065,166 | A * | 5/2000 | Sharrock et al. | ..... | 5/630 |
| 6,378,152 | B1 * | 4/2002 | Washburn et al. | ..... | 5/713 |
| 6,550,086 | B2 * | 4/2003 | Boyd | ..... | 5/706 |
| 6,709,246 | B2 * | 3/2004 | Boyd | ..... | 417/423.1 |
| 6,786,355 | B2 * | 9/2004 | Chirnomas | ..... | 221/9 |
| 6,971,133 | B2 * | 12/2005 | See | ..... | 5/706 |
| 2002/0124320 | A1 * | 9/2002 | Washburn et al. | ..... | 5/713 |
| 2003/0101516 | A1 * | 6/2003 | Hsu et al. | ..... | 5/710 |
| 2004/0133987 | A1 * | 7/2004 | Reeder et al. | ..... | 5/713 |
| 2007/0284384 | A1 * | 12/2007 | Chirnomas | ..... | 221/9 |
| 2008/0022460 | A1 * | 1/2008 | Yang | ..... | 5/706 |

* cited by examiner

*Primary Examiner* — Gilbert Lee

(57) ABSTRACT

A structural design and weld fabrication method for reinforced vinyl by eliminating butt seams, leaving 100% lap seams, as well as low cost, high strength internal beams for use in high quality air bed mattresses and all inflatable items.

2 Claims, 23 Drawing Sheets

FIG 2 SECTION II

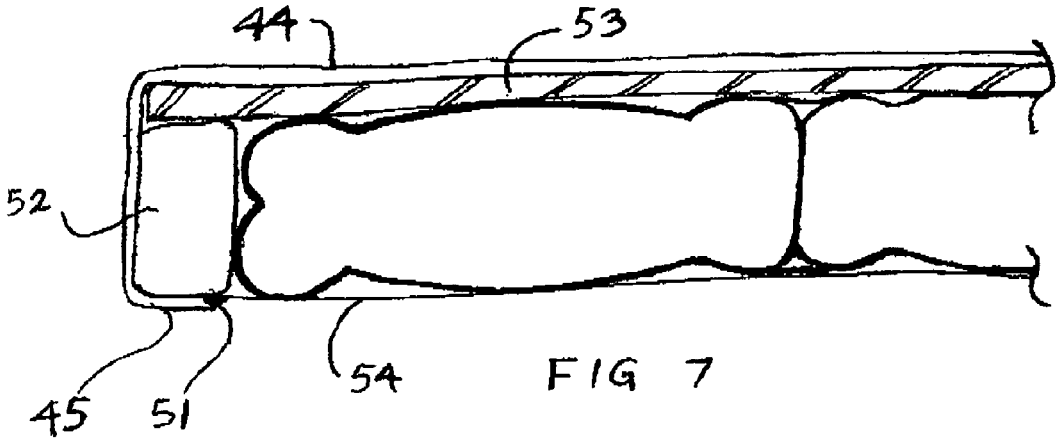
FIG 7
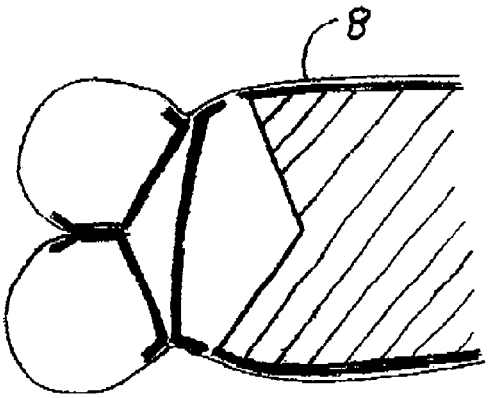
FIG 8
FIG 9
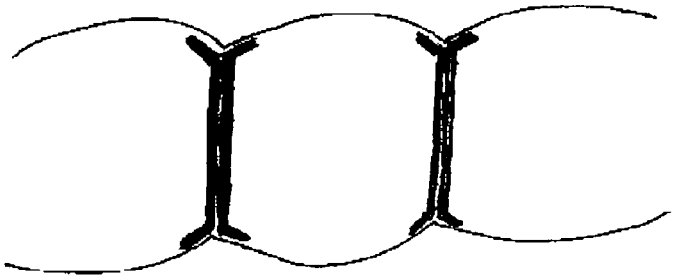

FIG 20 SECTION II

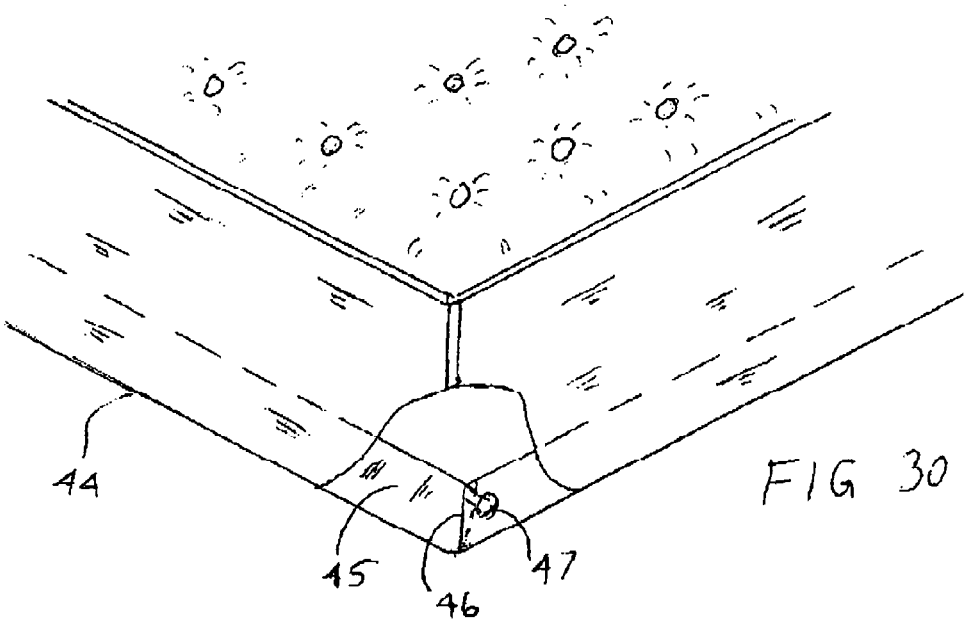
FIG 30
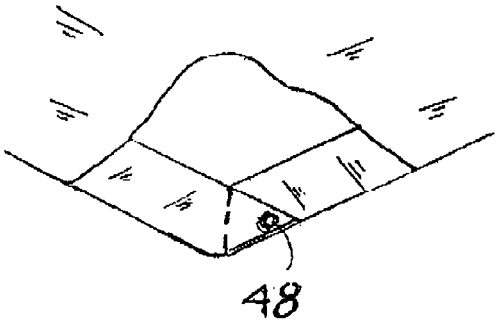
FIG 31
FIG 32
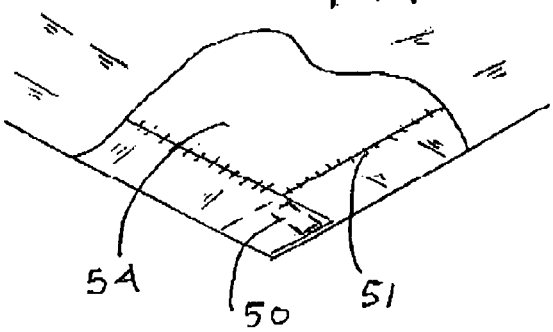
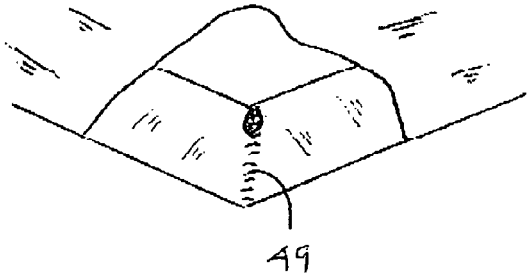
FIG 33

REINFORCED VINYL AIR MATTRESS

CROSS REFERENCE TO RELATED APPLICATIONS

The U.S. Pat. Nos. to:
(Bauhoffer U.S. Pat. No. 59,945)
(Arens U.S. Pat. No. 2,000,873)
(Perry U.S. Pat. No. 2,345,421)
(Perry U.S. Pat. No. 2,360,715)
(Nail U.S. Pat. No. 2,987,735)
(Nail U.S. Pat. No. 3,705,429)
(Nail U.S. Pat. No. 3,740,095)
(Howorth U.S. Pat. No. 3,778,851)
(Philipp U.S. Pat. No. 3,790,975)
(Reid U.S. Pat. No. 4,371,999)
(Chamberland U.S. Pat. No. 4,896,389)
(Barnett U.S. Pat. No. 5,010,608) disclose prior art air beds having beams for support.
(McCarthy U.S. Pat. No. 5,906,019)

BACKGROUND

1. Field of Invention

This invention relates to a structural design for inflatable objects using 100% reinforced vinyl with 100% lap seams allowing high strength by eliminating butt seams and making low cost I-beams for use in inflatable items such as air mattresses.

2. Background of the Invention

The standard method for fabricating inflatable objects made with flexible vinyl or polyurethane materials such as air mattresses, inflatable rafts, toys, etc., is by joining all the seams by means of radio frequency (RF) heat sealing. Within the industry the majority of the seams are made with seams called butt welds. As greater strength and reliability for the welds due to use and higher pressures, lap seams were preferred over butt seams. It is known that butt seams will provide only 70 to 80% of the material strength and lap seams can provide 100% of the material strength for non-reinforced vinyl.

Reinforced material, primarily one sided reinforced material, allows for stronger product and can handle higher pressures and greater durability (double sided reinforced vinyl is thick and expensive to produce). The industry problem when using one sided reinforced material is being able to do lap seams for all the joints. This is because the limitation that only the smooth non-reinforced surfaces of the materials could be sealed to each other and still have the matted texture on the outside for the entire surface of the product. It would be possible to have the matted on the outside on say the top surface and smooth on the bottom surface of the mattress and have the smooth sides facing each other to form a lap seam along perimeter of the sides, but the corners would still need the butt welds for both top and bottom. Welding to the rougher reinforced surface would not work in the RF sealing process. The industry has never been able to find a method to weld without avoiding the butt seam. Even if a method was found, the internal I-beams required butt welds that would peel and result in bulging of the mattress or tear at the end of the I-beam resulting in a leak, hence there was no net gain in durability. Fundamentally, there are a number of links in the burst strength chain to produce a high pressure mattress. The additional cost and as well as no perceived need for the higher pressure deterred the development of such a product. As well, the comfortable sleeping pressure is usually under 1 p.s.i. The market conditions have changed since the higher material costs relative to the cheap foreign labour in conjunction with a high end or high quality type of air bed, have inspired the applicant to pursue this invention.

Therefore to produce an inflatable product with 100% lap seams when using 100% one sided reinforced materials has not been accomplished up to this time.

This invention is a novel way of designing inflatable reinforced vinyl objects to eliminate butt seams, which tends to weaken the product, and replace the butt seams with lap seams. The invention also overcomes weakness in the C-beam type of construction with the addition of I-beams in reinforced vinyl as well as non reinforced vinyl. This entails a combination of sewn I-beams made from two strips of reinforced vinyl for flange, and as well as low cost fabrics for the web of the beam. The 3 materials are sewn together to form an I-beam. The flanges are sealed to the top and bottom of the inflatable structure. This divides the tensile load over 2 welds and will make the seam act as a lap seam rather than a butt seam due to the angular direction of the peel force. The peel force in the single weld C-beam used to shape the object, has the peel force perpendicular to the surface rather than the applicant's design which reduces the resultant peel force angle, as well as reducing it by half due to the Y or I shape double weld area to the outer surface. The sewn fabric web of the beam provides the necessary strength and is cheaper than the cost of vinyl.

Typically for air mattresses and inflatable toys, the strength was limited to the strength of the butt seam. Even with lap seams in areas where the seam could be used there would normally always be some areas required to use a butt seam for the final closing or for the corners of a structure. These devices would fail over time from abuse causing high pressures, such as jumping or dropping on the bed causing a short high pressure that incrementally peels or stretches a weak point of a butt weld.

The high quality air mattresses and inflatable rafts were made of cloth and vulcanized rubber for this reason. Reinforced vinyl has been very limited due to the failure of the C-beam weld is no stronger than as with non reinforced vinyl, and failure would result along this C-beam or the butt weld, and not the outer vinyl. The additional cost of reinforced vinyl did not produce a superior product.

Currently, there are two types of air mattresses: a coil air mattress and an I-beam air mattress. These air mattresses are made of plain or flocked PVC sheeting. The flocking material used on air beds with flocked PVC is a non-woven material and consequently the flocking does not promote the strength, durability, or puncture resistance of the air mattress. The PVC sheeting has a coil or an I-beam air mattress joined by the use of butt seams.

Discussion of McCarthy

The object McCarthy's invention is to provide; an air mattress having oval beams for rigid, underlying support thus eliminating stress points at the end of an I-beam, an air mattress having a comfortable top sheet made of PVC backed textile fabric material, and to add corner strips or patches to obtain the superior lap type seams at the corners. The flocking or woven top sheet is to prevent plasticizer migration from the inner top sheet.

McCarthy does not have a mattress made of reinforced vinyl, but rather a cloth or flocked material laminated onto the vinyl and non-reinforced vinyl bottom lap seamed to the top. This top laminated material is cut back from the edge to allow welding at the seams, including the corner strips. The applicant does not require this additional preparation, but is able to used flocked or reinforced vinyl and either reversed smooth surface out/in construction, heavy gauge smooth patch, or reinforced double smooth sided patch to achieve the same or better resultant lap weld. McCarthy still has butt welds for the underlying support, but has at least reduced the end point stress by using oval beams that are butt welded to the top and bottom sheets. His conclusion brings him to the conventional design in the assumption that there is no need to use the higher strength reinforced vinyl since the failure will be due to the butt welds on the oval beam peeling from the top or bottom sheet resulting in bulges, or tearing resulting in leaks. The applicant has eliminated the weak links of butt welds in the beams, seams and corners, while using an all-reinforced vinyl construction, and is thus able to fully realize the additional strength of the reinforced vinyl.

OBJECTS AND ADVANTAGES

1. This invention is a mattress with made from reinforced vinyl material or matted texture finish on one side and smooth weldable surface on the other, designed to eliminate all butt weld seams from the external joints or seams, resulting in an increase in ultimate burst pressure from 3 p.s.i. to 9 p.s.i. for the same material. This realizes the advantage of the stronger reinforced material rather than the limitation of the butt weld burst strength.
2. By using low cost fabric for the I beams and squaring beams instead of reinforced vinyl in conjunction with sewing and sewing area patch (to seal the holes of the stitches), burst pressure is increased by replacing the traditional butt weld with a sewn seam and a sewing area patch to seal it, as well as material cost reduction. The patch also flattens the indent made by the beams by providing an inflated web which spans the valley created by the tension of the beam.
3. Vinyl flanges and reinforced vinyl flanges of I-beams double the welded area and create 2 welds instead of one butt weld where the beam is welded to the outer surface. The tight or short distance directs the tensile force of now 2 welds in shear or lap configuration rather than the single perpendicular peeling force of a single butt weld. These flanges also allow low cost fabric to be used for the web of the I-beam rather than the more expensive reinforced vinyl and eliminate butt welds from the inner members. The elimination of the inner I beam welds as well as the external butt seam welds allow the burst strength or the reinforced vinyl to be realized as the failure mode.
4. To provide a sensor that measures pressure in the mattress without having electrical or hermetic feed through mattress ports by means of tube within the hose and an easy to install connector design that allows for disconnection from the pump without deflation occurring. This eliminates having to provide and install a separate external hose and or electrical sensor wires between the controls and the mattress by combining these with the hose/pump connector, which is usually installed by the consumer. The sensor hose is able to accurately measure the mattress pressure while the air pump is pumping in order allow the mattress pressure memory function of the control to operate properly without overshooting or having to stop for pressure measurement reading to reach the desired mattress pressure. This is because the pressure near the pump is higher than in the mattress when the air pump is pumping. A self aligning low pressure valve seals a square profile section o-ring against of the beveled seat of the pump connection.
5. Use of a double smooth reinforced vinyl for corner patches to allow welding of reinforced vinyl main body of the mattress.
6. Using a extendable type of mattress port to allow easy attachment of hose to mattress as well as add a disconnect valve and provide a large enough opening to remove the lap seam tooling once the final weld is made. It also prevents an obstruction projecting past the surface of the mattress besides a hose and allows the hose to angle in the desired direction which is sometimes along the side of the mattress and not perpendicular to the side.
7. Cover relief by providing one or more perimeter relief fastener for ease of assembly of cover over mattress and/or foam edge rails. The zipper can be easily zipper closed or zipper eliminated because the lower perimeter fabric can be made wider to hold the air core and still be slipped over the mattress components.
8. double sided reinforced vinyl patch or thick non-reinforced vinyl patch for sealing 3 intersecting edges of reinforced vinyl allows reduction in material costs as compared to a whole mattress made of thick or double sided reinforced vinyl.
9. The reinforced vinyl seam patch allows similar sides to be inward or outward, rather than say the top to have smooth side out and the bottom to have smooth side in so a lap seam can be welded smooth to smooth side. This enhances desired uniform finish texture and appearance.
10. The combination of reinforced seam patch, and union patch make the fully lap seam reinforced construction possible for the outer surface and allows for the top and/or bottom to extend a flap while still having a lap seam. The prior art method has the side join at 90 degrees or greater in order to have sides of a double mattress without an soft spot between them (see FIG. 20 PRIOR ART enlargement).
11. a method for producing a squared mattress edge using reinforced vinyl and conventional butt welds in areas of the mattress where the butt weld is not the failure mode.

The air mattress is inflated with air and expands to produce a sleeping support surface for everyday use. The air mattress is constructed for use with foam frames and provides novel aspects not before provided by prior art air mattresses.

While very simple forms of the invention have been described, it will be understood that the invention has wide application and various modifications of structure may be made by those skilled in the art without departing from the spirit of the invention or scope of the appended claims.

BRIEF DESCRIPTION OF THE DRAWINGS

FIG. 7—shows the side by side mattress assembly

FIG. 8—shows an alternative embodiment mattress squared edge structure

FIG. 9—shows I beam configuration alternative embodiment

FIG. 18—Section III-III shows weld patch configuration

FIG. 30—shows an air bed cover with perimeter button and loop

FIG. 31—a snap or Velcro alternative embodiment instead of button and overlapping of the lower perimeter.

FIG. 32—shows an elastic material 50 alternative embodiment and a perimeter zipper FIG. 33—shows a release zipper alternative embodiment and a wider base perimeter FIG. 34—is a three dimensional transparent view of valve solenoid, self aligning valve, pump connection, and hose connection with pressure sensor line FIG. 35—is a view of the pump valve FIG. 36—is an enlargement of the valve of FIG. 35

DEFINITION OF TERMS reinforced vinyl refers to a vinyl or PVC (polyvinyl chloride) or other polyurethane sheet or other materials that are radio frequency weldable, having nylon or other similar thread like reinforcement having laminated or produced with a single sided smooth vinyl surface on one side, which is also the weldable side, and the (rougher) fiber reinforced surface on the other side double sided reinforced vinyl—is the same as reinforced vinyl refers but with both sides smooth vinyl or PVC with the reinforcement material between, so that it is weldable on both surfaces. This is more expensive and complicated manufacturing process than the one sided material.

low cost fabric beam is internal beam made from one or more reinforced vinyl flanges to be welded and a fabric or any other low cost non-weldable material that forms the web of the beam which is sewn to the flange or other web. The web may also be vinyl or reinforced vinyl that can be sewn or welded to the flange.

reinforced vinyl seam patch—is a strip of reinforced vinyl that has it's smooth side welded to the smooth sides of adjoining edges of the reinforced vinyl of the outer surface. (this patch may also be a thick non-reinforced vinyl)

union patch—is a piece of double sided reinforced vinyl or thick non-reinforced vinyl that seals the intersection of 3 or more adjoining edges of the reinforced vinyl outer surface. non-reinforced heavy gauge vinyl patch 12*a*. and double sided reinforced vinyl 12*b*, are both union patches

DETAILED DESCRIPTION OF THE PREFERRED EMBODIMENT

Figure 1:
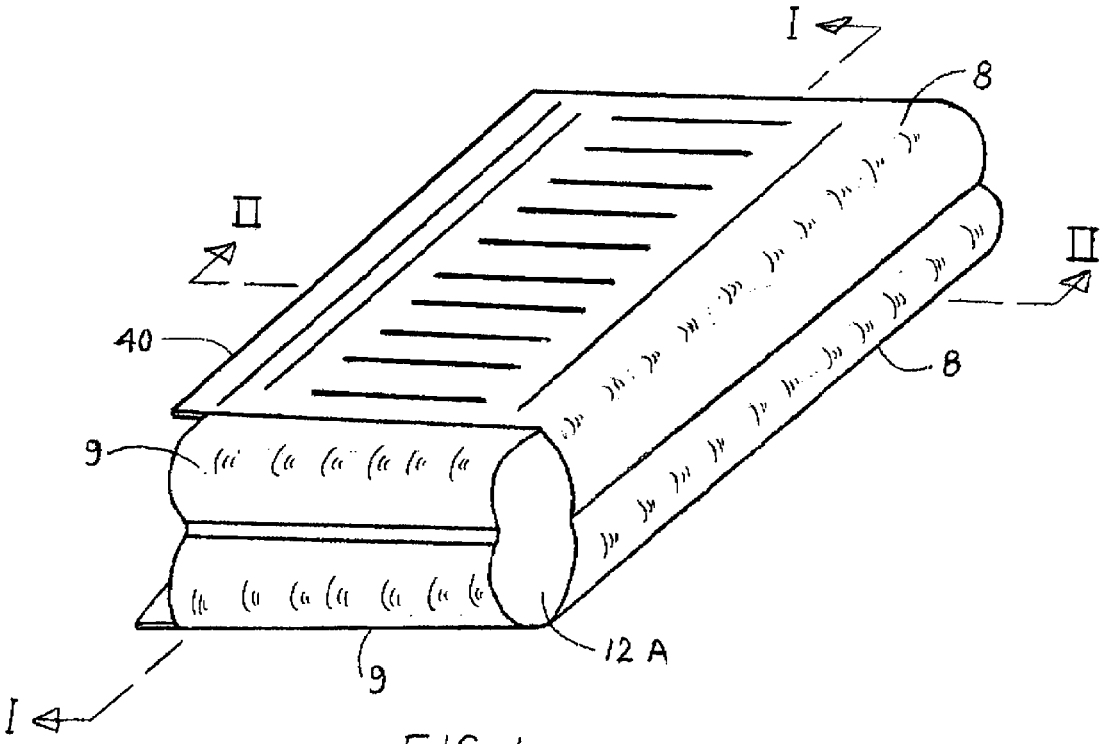
FIG. 1—shows half of a double mattress air core made of reinforced vinyl

FIG. 1—preferred embodiment of the invention showing half of a double mattress air core made of reinforced vinyl, except the corners are made of a heavy gauge vinyl or preferred double sided reinforced vinyl 12*b*. The outer air core is also totally constructed using lap or flat seam welds. There are no butt welds. The edges are squared using a single horizontal center beam or reinforced edge beam 7

Figure 2:
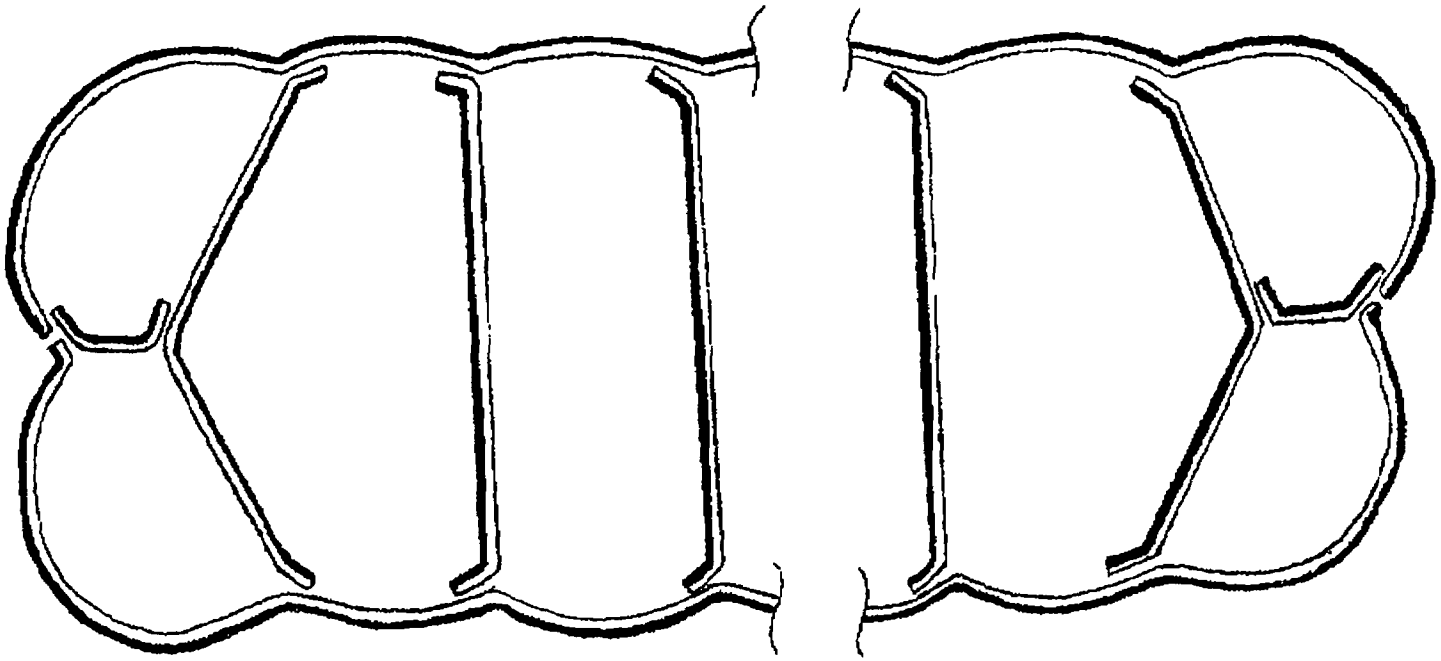
FIG. 2—is a cross section view along of FIG. 1. The heavy lines represent the rough reinforced surface of the vinyl and the light line and space between lines represent the smooth side (this pictorial representation will apply to all drawings). The beams are a butt weld and a squared mattress edge with lap seam is shown.

FIG. 2—is a cross section view along I-I of FIG. 1 having a reduced length for clarity. The heavy lines represent the rough reinforced surface of the vinyl and the light lines and space between lines represent the smooth side (this pictorial representation will apply to all drawings). The beams in this figure are made of reinforced vinyl as well, and use a butt weld at each end no butt welds a method for producing a squared mattress edge using reinforced vinyl and conventional butt welds in was of the mattress where the butt weld is not the failure mode.

Figure 3:
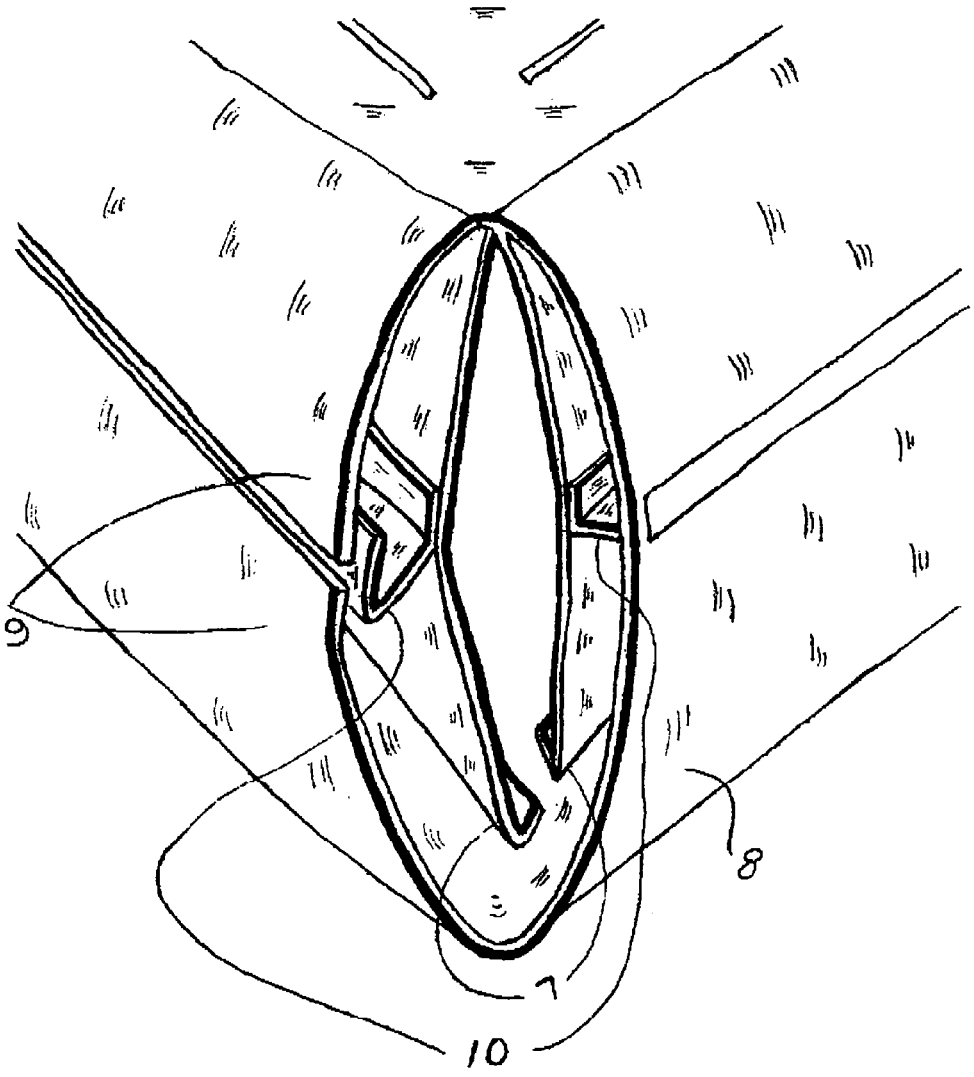
FIG. 3—shows the radius corner design using non-reinforced vinyl corner.
Figure 20:
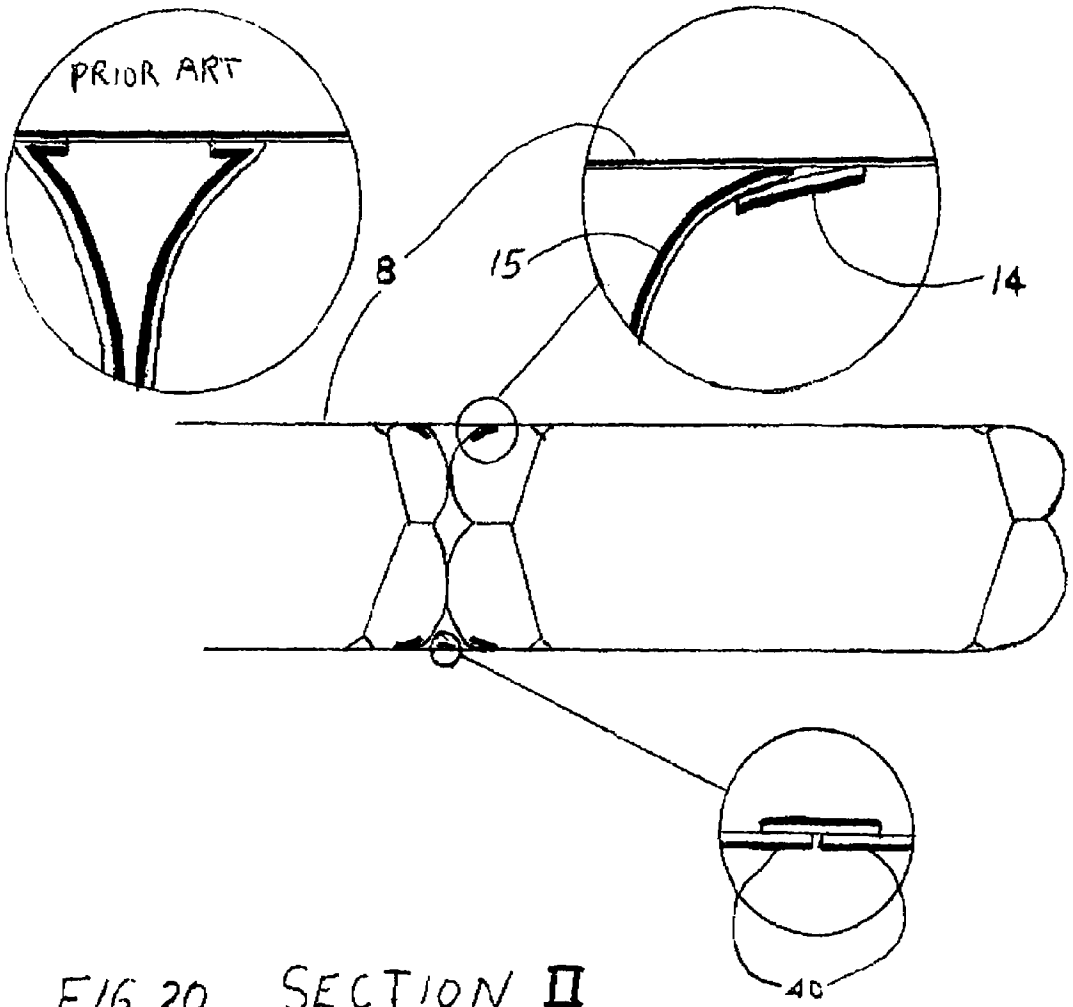
FIG. 20—is the section II-II from FIG. 1 and shows the weld configuration for the flap area.

FIG. 3—shows the radius corner design using non-reinforced vinyl corner. The corner 11 is omitted from the drawing. Both the top and bottom outer surface end tab 9 has each edge welded as a lap seam along the reinforced squaring beam 10 so that these edges are abutted, not overlapping each other. The side of the mattress is shown as a continuous part of the top and bottom outer surface 8. The other side may be similar for a single mattress or use the double mattress linking method (FIG. 20). The reinforced squaring beam 10 is welded to the smooth side of the reinforced edge beam 7, which in turn has it's upper and lower edges butt welded to the to the smooth inner surface of the top and bottom outer surface 8. If butt seams are to be eliminated from this configuration, then the external lap seam is located above or below the beam weld using the weld configuration of say FIG. 12 or FIG. 13.

Figure 4:
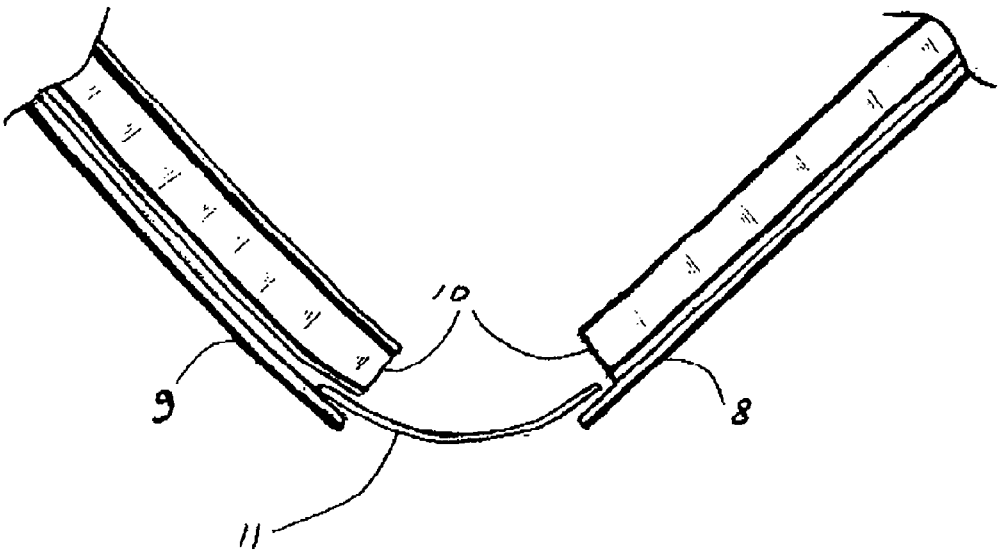
FIG. 4—shows a top view of FIG. 3

FIG. 4—shows a top view of FIG. 3 showing the non-reinforced heavy gauge vinyl corner 11 or position relative to both reinforced squaring beam 10 with end of mattress on the left and side of mattress on the right side of the drawing. The corner may also be a double sided reinforced vinyl patch.

Figure 5:
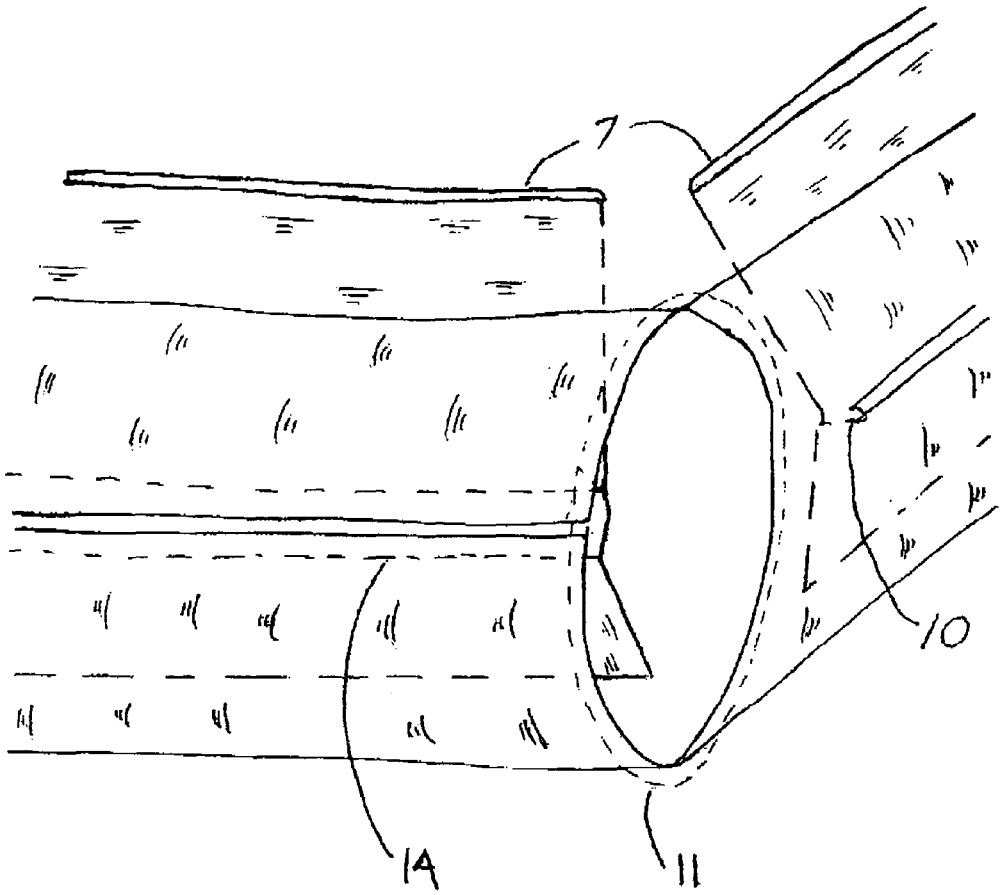
FIG. 5—assembled view of corner

FIG. 5—is similar to FIG. 3 but an assembled view and one of the reinforced edge beam 7 (left one) does not have a reinforced squaring beam 10 uses 7 as part of a reinforced vinyl seam patch 14

Figure 6:
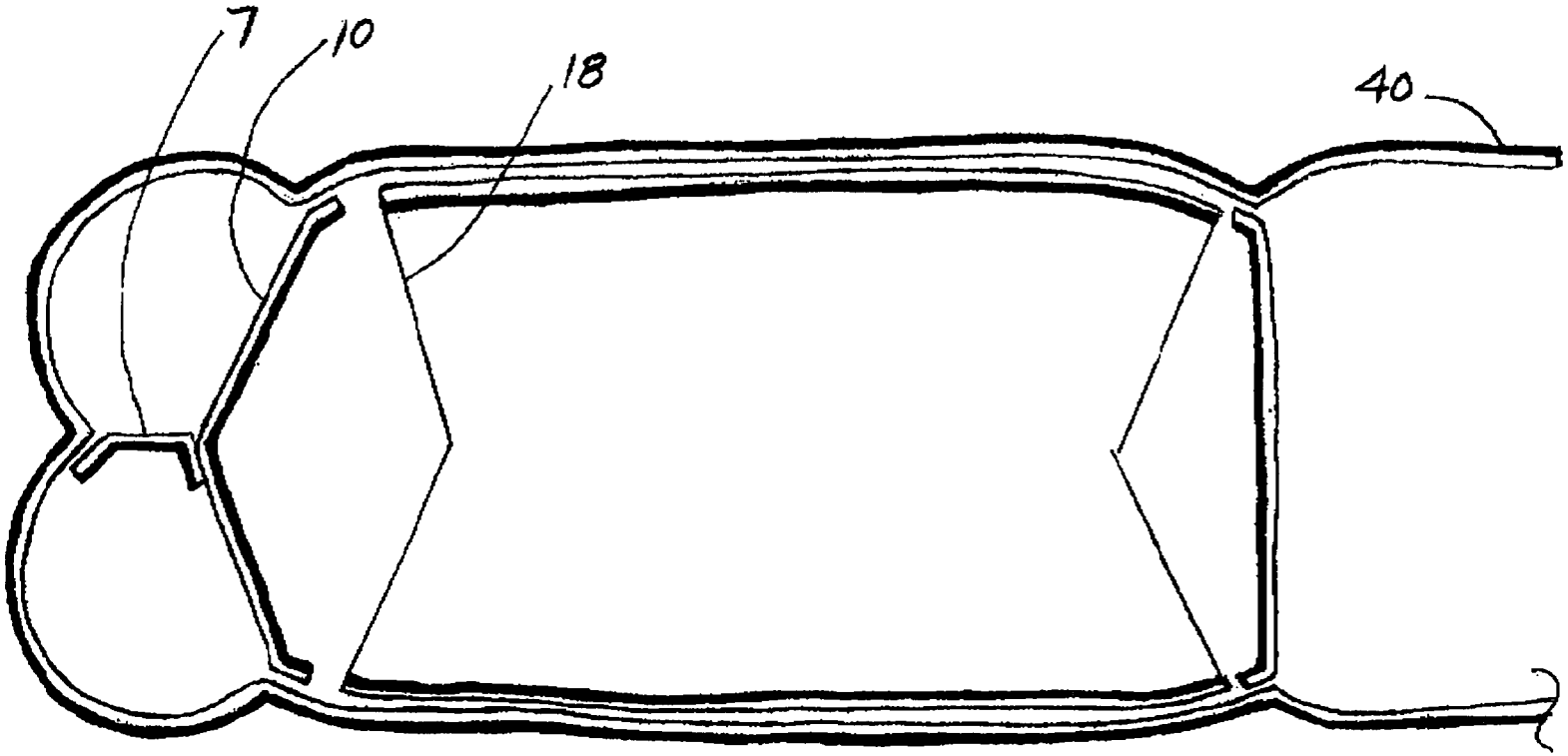
FIG. 6—shows a mattress squared edge structure

FIG. 6—shows a mattress squared edge structure (left side). The right side is the same but flap 40 and continuous bottom shown which would be the bottom for an adjoining air core. A low cost fabric beam 18 (front view) is shown. 18 could also be reinforced vinyl.

FIG. 7—shows the side by side position from either the head or foot view of the mattress with a foam layer 53 on top of the air cores and cover 44 assembled over mattress components for a double air core. The cover is pulled over the components and then the perimeter fastener 48 of the lower perimeter 45 is secured. The perimeter zipper 51 is closed to secure the mattress.

FIG. 8—same as FIG. 6 but shows alternative embodiment squaring configuration. Smooth side of the vinyl welded to smooth side of top and bottom outer surface 8

FIG. 9—shows I beam configuration alternative embodiment using to back to back C-beams that may or may not be welded together.

Figure 10:
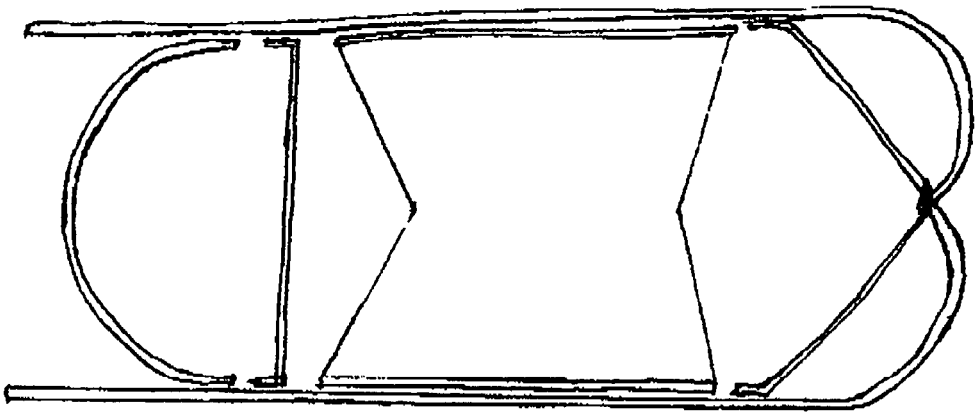
FIG. 10—shows non squared interior side

FIG. 10—shows non squared interior side

Figure 11:
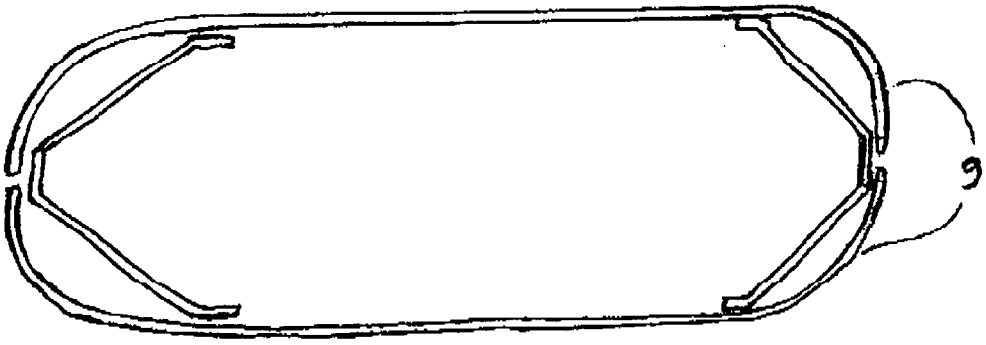
FIG. 11—shows lap seamed edges welded to squaring beam

FIG. 11—shows lap seamed edges welded to squaring beam

Figure 12:
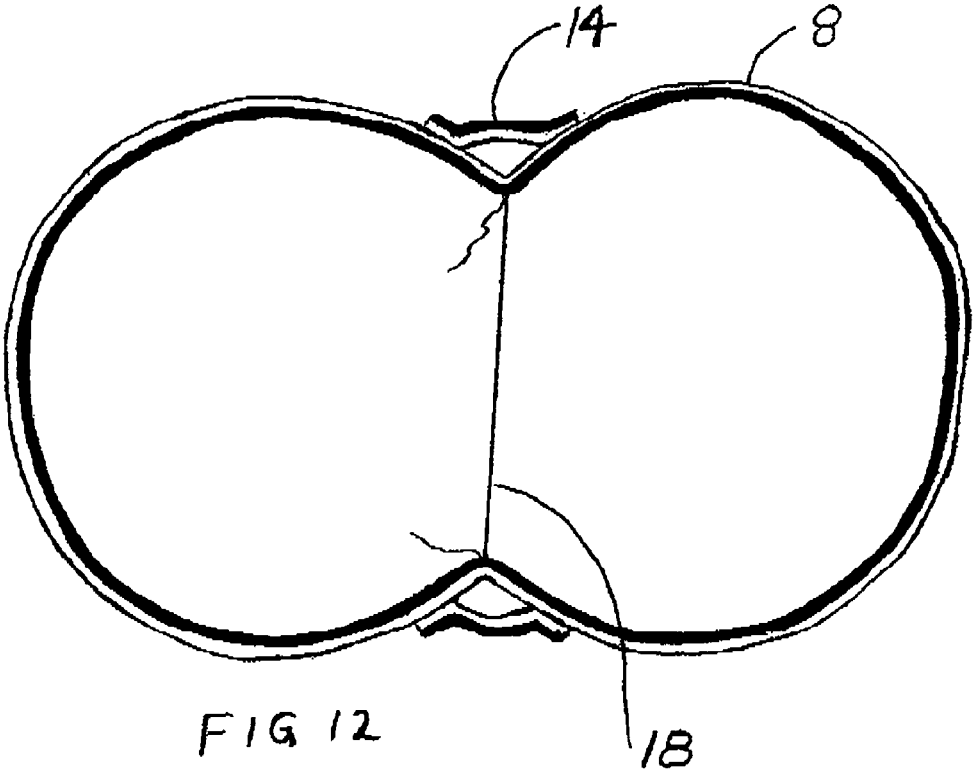
FIG. 12—shows the basic weld and beam configuration with low cost fabric beam sewn to the hermetically sealed exterior top and bottom surface and the reinforced vinyl seam patch FIG. 13—shows an alternative embodiment to the butt welded beams FIG. 14—shows typical configuration in an air core of multiple beams but using the sewn beam design FIG. 15—shows squared edge using the sewn beam for the horizontal squaring beam.

FIG. 12—shows the basic weld and beam configuration with low cost fabric beam 18 sewn to the hermetically sealed exterior top and bottom surface 8 and then the reinforced vinyl seam patch 14 welded to 8 to seal the holes created by the sewing stitches. The patch can also be non reinforced vinyl and provides a more flat sleeping surface. The volume inside the patch 14 and surface 8 is inflated by leakage through the stitch holes or can have larger holes cut through 8 for rapid inflation and deflation. The patch 14 extends past the end of the beam 18 to enclose the entire sewn area.

Figure 13:
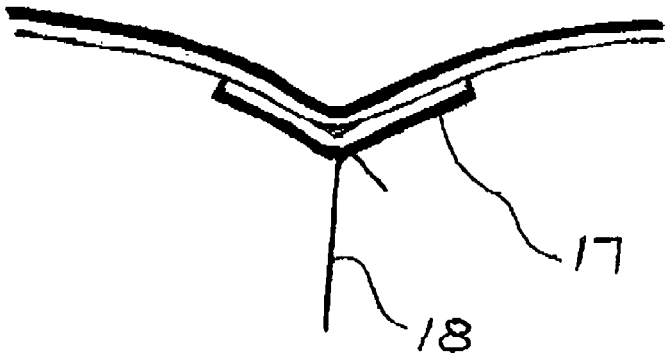

FIG. 13—shows an alternative embodiment to the butt welded beams that improve burst limit. The smooth surface of the reinforced vinyl of the outer surface of the core is on the inside and is welded to the smooth side of the reinforced vinyl flange 17 near to both sides of the stitch to the low cost fabric beam 18. The force of the peel is less than perpendicular as is typical in butt welds, and by welding close to sewing stitch the peel force is in shear as typically found in lap welds.

Figure 14:
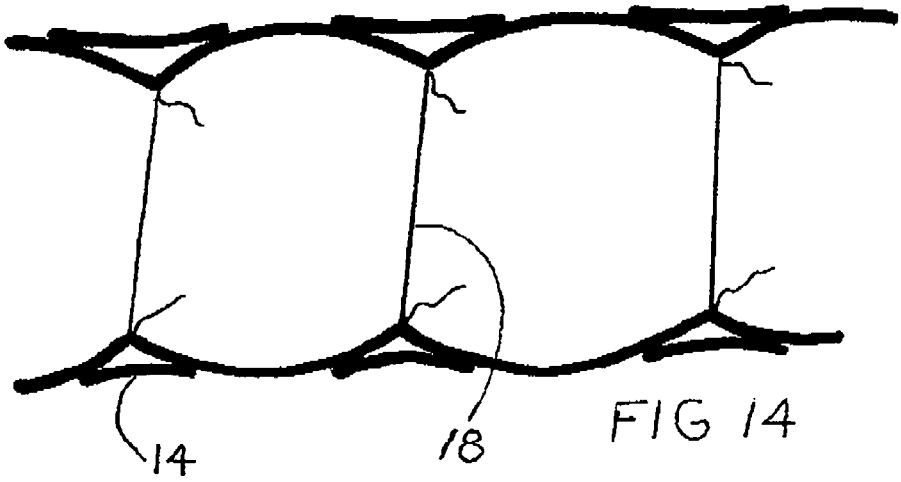

FIG. 14—shows typical configuration in an air core of multiple beams but using the sewn beam design of FIG. 13 having smooth weldable surfaces welded to each other.

Figure 15:
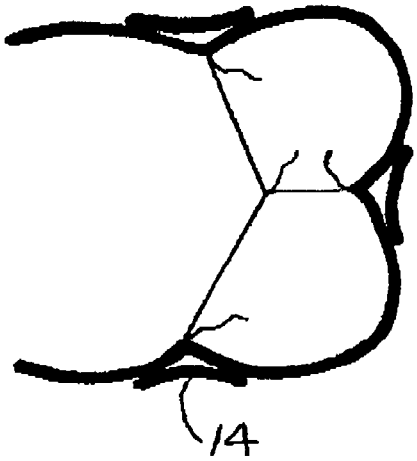

FIG. 15—shows a squared edge using the sewn beam for the horizontal squaring beam.

Figure 16:
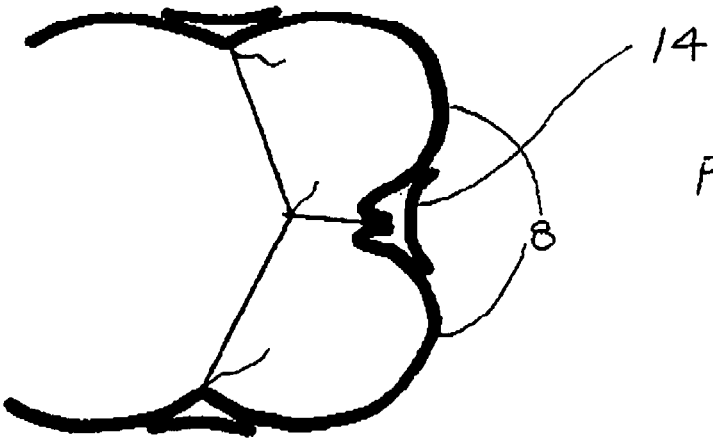
FIG. 16 shows an alternative method for the sewn squaring beam

FIG. 16 shows an alternative method for the sewn squaring beam to also have the top and bottom outer surface 8 parting seam for the top and bottom to be sewn and then sealed by reinforced vinyl seam patch 14.

Figure 17:
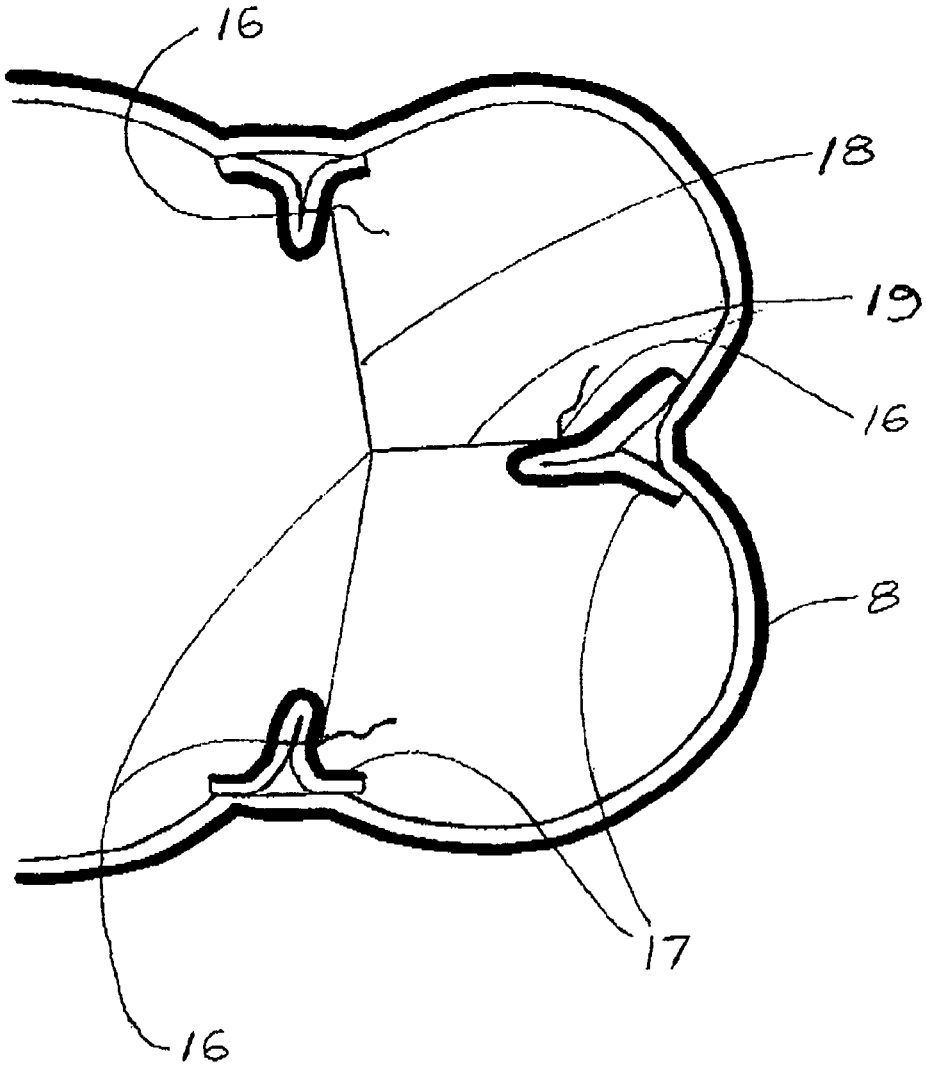
FIG. 17—shows squaring edge construction without patches

FIG. 17—shows squaring edge construction without patches with a small volume between the top and bottom outer surface 8 and reinforced vinyl flange 17 which does not have ends sewn for inflation and deflation purposes.

FIG. 18—Section III-III shows the smooth surfaces to be welded to smooth surfaces using non-reinforced heavy gauge vinyl patch 12*a*, or a double side reinforced vinyl 12*b*. 12*b* is smooth on both outer sides and can be substituted for 12*a*. which is hence sandwiched between top and bottom outer surface 8 and reinforced vinyl seam patch 14. The small size of the patch does not add significant material cost.

Figure 19:
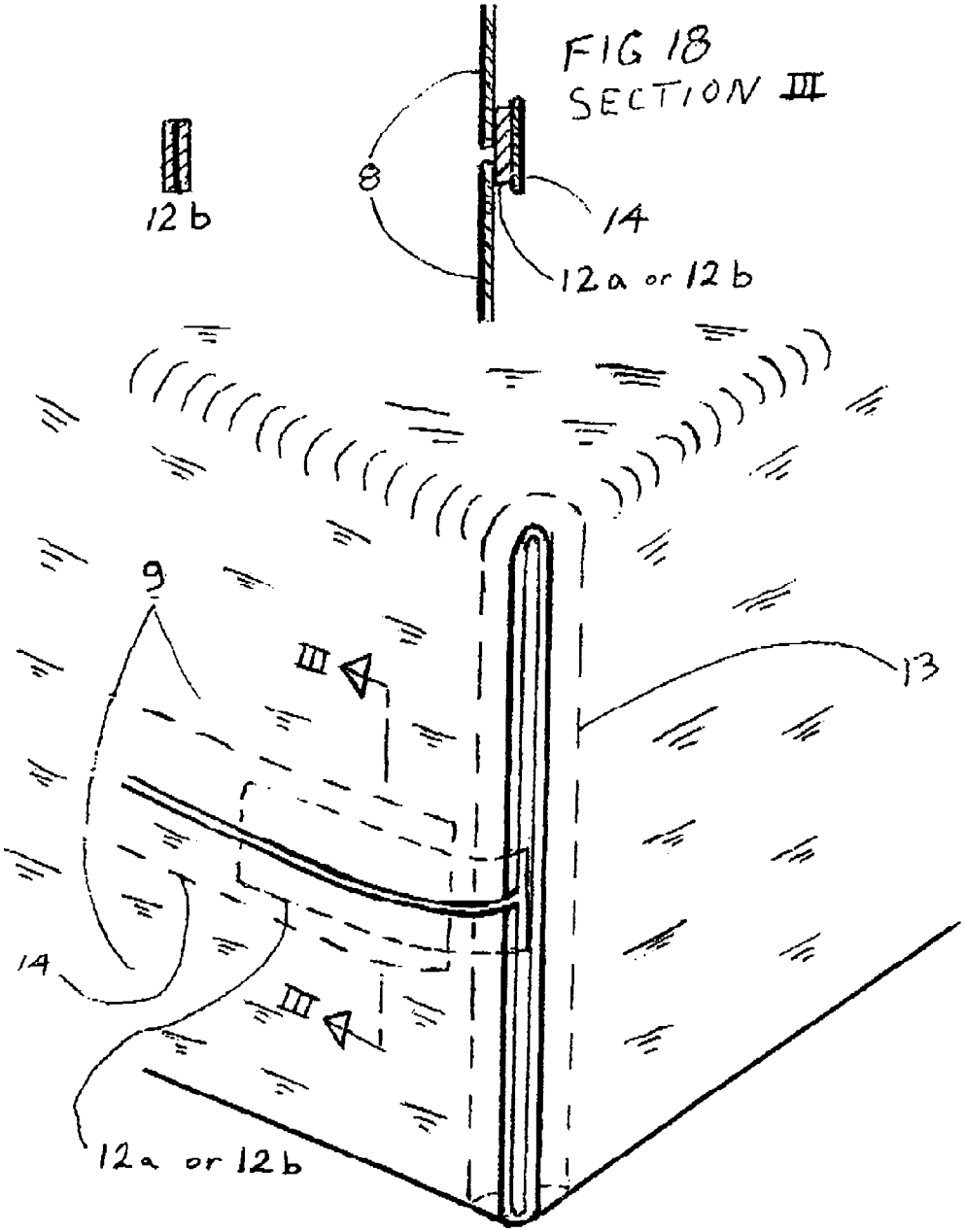
FIG. 19—shows a three face intersection and patch configuration.

FIG. 19—shows a three face or edge intersection area non-reinforced heavy gauge vinyl patch. 12*a*, or a double side reinforced vinyl 12*b* is used to seal this area without reducing the overall burst pressure. Four corner intersection is similar but extends 12*a* or 12*b* to go between fourth corner. The horizontal seam may be located higher or lower or at the corner. The reinforced vinyl corner 13 is welded with to the smooth side over patch 12*a* or 12*b* which is hence sandwiched between top and bottom outer surface end tab 9 and reinforced vinyl corner 13.

FIG. 20—is the section II-II from FIG. 1 and shows the weld configuration for the flap area. The top flap shows a continuous top vinyl for two mattresses. The bottom shows independent flaps welded together. The top may also be independent flaps welded, as well as the bottom continuous. The end intersection of the weld with a third face for the top enlarged view is similar to the weld technique shown in the intersection of FIG. 19 and would require a patch 12*a* or 12 *b* to seal at the intersection of bottom outer surface end tab 15, reinforced vinyl seam patch 14, and top and bottom outer surface 8. The bottom enlarged view does not require sealing since it is between the two mattresses.

Figure 21:
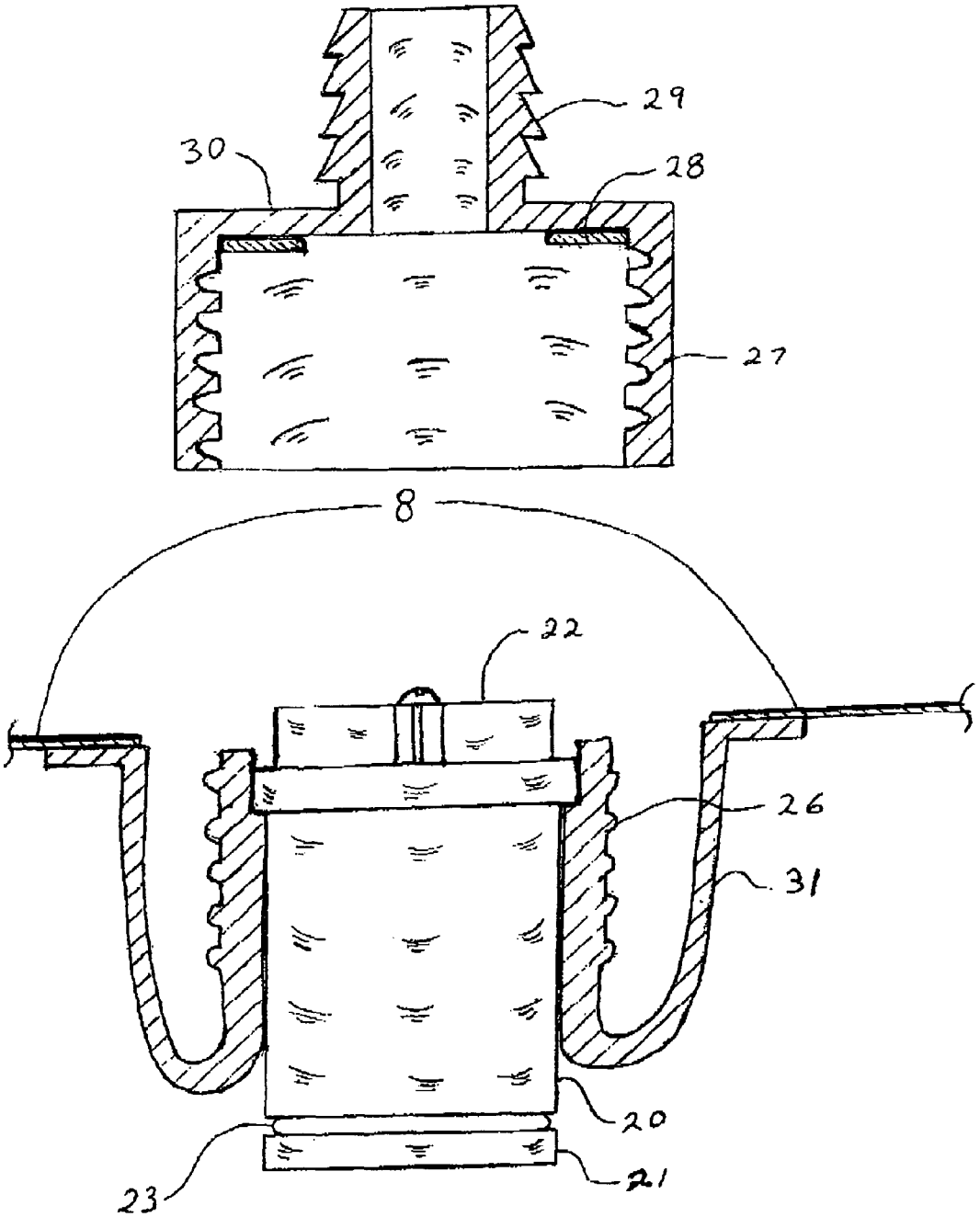
FIG. 21—shows a non swivel mattress connector and mattress port sectional view with mattress port disconnect valve.

FIG. 21—shows a non swivel mattress connector 30 sectional view that would thread onto mattress port thread 26 of the mattress port 31. The flange of the port is welded to the outer surface 8 and may be pulled outward to extend past the surface of the mattress for threading. The washer 28 will be compressed to seal against the rim of the mattress port 31 at the same time pushing valve stem 22 inward (downward) opening the disconnect valve which is seated inside the body of the mattress port 31, giving the walls and rim of 31 radial structural support.

Figure 22:
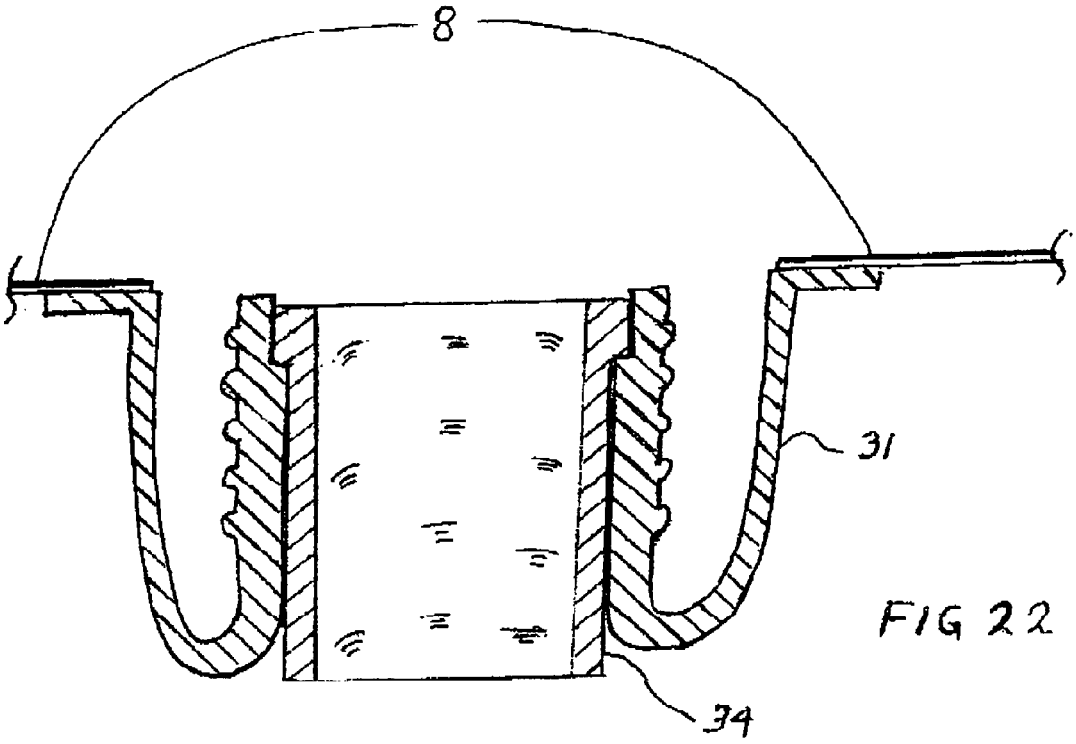
FIG. 22—shows a mattress port insert which is seated inside the body of the mattress port FIG. 23—shows a swivel mattress connector FIG. 24—is a sectional view of a mattress disconnect valve FIG. 25—is an exploded view of a mattress disconnect valve.

FIG. 22—shows a mattress port insert 34 which is seated inside the body of the mattress port 31, giving the walls and rim of 31 radial structural support. The washer 28 of a non-swivel mattress connector 30 will be compressed to seal against the rim of the mattress port 31.

Figure 23:
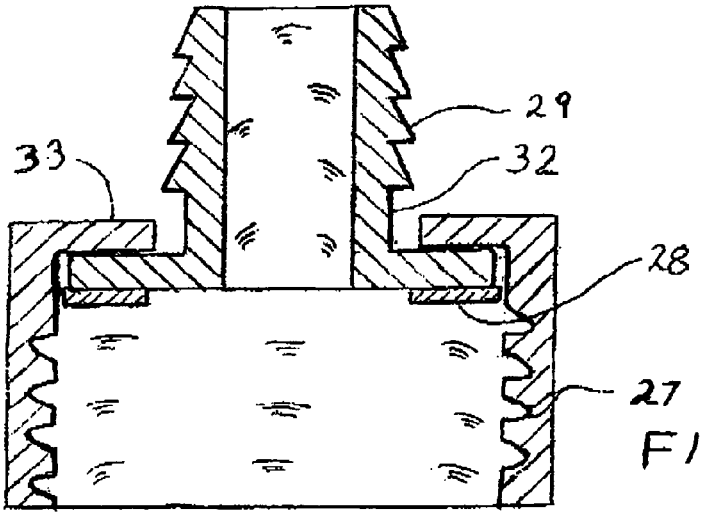

FIG. 23—shows a swivel mattress connector 33 which is interchangeable with non-swivel mattress connector 30. This would prevent hose twist if the hoses are not preassembled like the non-swivel connector application.

Figure 24:
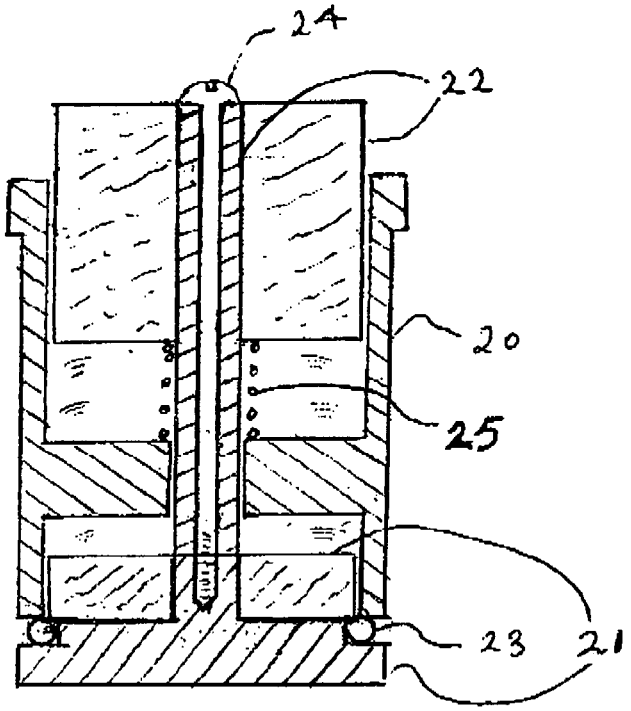

FIG. 24—is a sectional view of a mattress disconnect valve which seats in the mattress port 31. The disconnect valve housing 20 is seated inside the body of the mattress port 31, giving the walls and rim of 31 radial structural support. The spring 25 push the disconnect valve plate 21 against the disconnect valve seal 23 when the non swivel mattress connector 30 is removed. When the 30 is threaded on to the mattress port thread 26, the washer 28 pushes the disconnect valve stem 22 inward and opens the valve.

Figure 25:
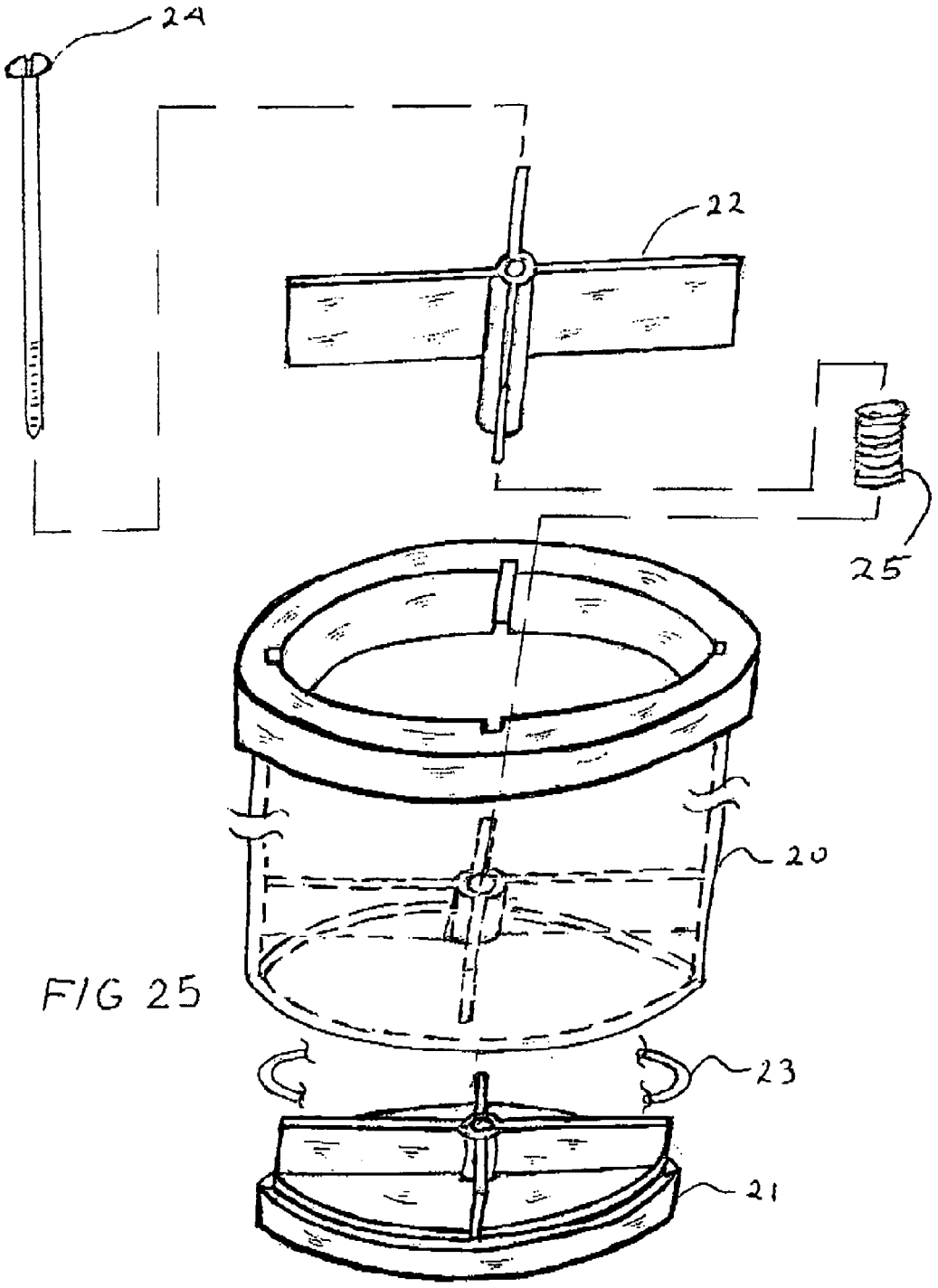

FIG. 25—is an exploded view of a mattress disconnect valve.

Figures 26, 27, 28:
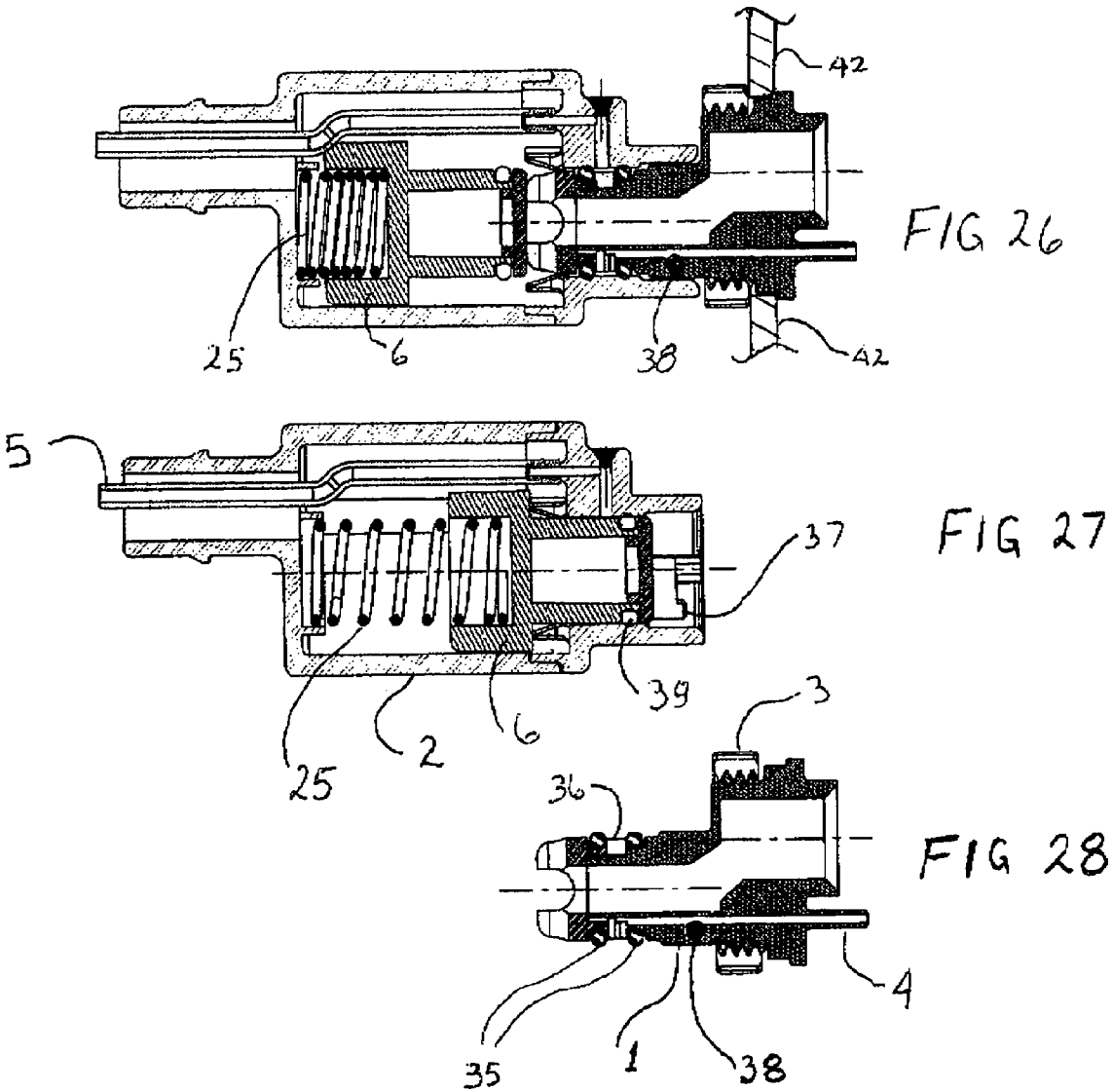
FIG. 26—shows the hose connector with pressure sensor line secured to pump connection FIG. 27—shows the hose connector with pressure sensor line in its closed position FIG. 28—shows the pump connection FIG. 29—is an assembly drawing showing the pressure sensor line protrusion into the mattress.

FIG. 26—shows the hose connector with pressure sensor line 2 secured to pump connection 1. The spring 25 is compressed allowing the disconnect plug 6 to become unseated opening the main airway as well as the pressure sensor airway. The twist lock projection 38 holds and locks the hose connector 2 to the pump after pushed, twisted, and when released, it is locked by twist lock slot 37.

FIG. 27—shows the hose connector with pressure sensor line 2 in its closed position with spring 25 extended pushing disconnect plug 6 into the housing and sealing disconnect seal 39 to housing and disconnect plug 6. The pressure sensor airway is also sealed. A small diameter hose is secured over hose connection pressure line hose barb 5 prior to the air hose being secured to the hose barb during manufacture.

FIG. 28—shows the pump connection 1 not mounted in the air pump 42 housing. The pump connector nut 3 secures pump connection 1 to the pump housing as shown in FIG. 26. The two o-rings 35 seal the pressure sensor airway from the air pressure in the air hose and form part of the pressure sensor airway 36.

Figure 29:
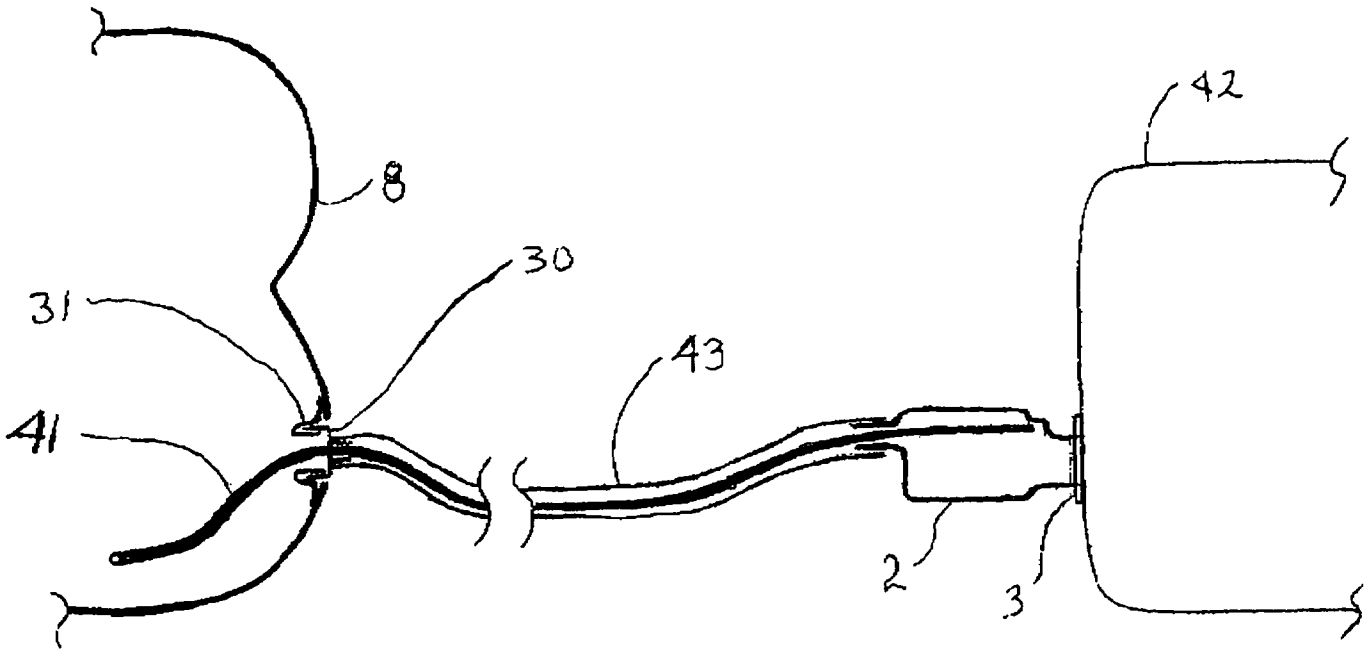

FIG. 29—is an assembly drawing showing the pressure sensor line (or small diameter hose) 41 running inside of the air hose 43 and its protrusion into the mattress.

FIG. 30—shows a air bed cover 44 with a lower perimeter 45 which is used to form a grip edge for the cover to hold it in place. A perimeter release 46 allows the inner edge of the lower perimeter 45 to be opened for ease of assembly so that the lower perimeter can slip over the mattress components and then be secured by perimeter button 47.

FIG. 31—is similar to FIG. 30 but has perimeter fastener 48 such as a snap or Velcro as well as showing an overlapping of the lower perimeter.

FIG. 32—is similar to FIG. 30 but has an elastic material 50 to allow for ease of assembly and also shows a perimeter zipper 51 which closes the entire cover FIG. 33—is similar to FIG. 30 but shows a release zipper 49 instead of a fastener as well as a wider base perimeter which is made possible due to the perimeter release mechanism.

Figure 34:
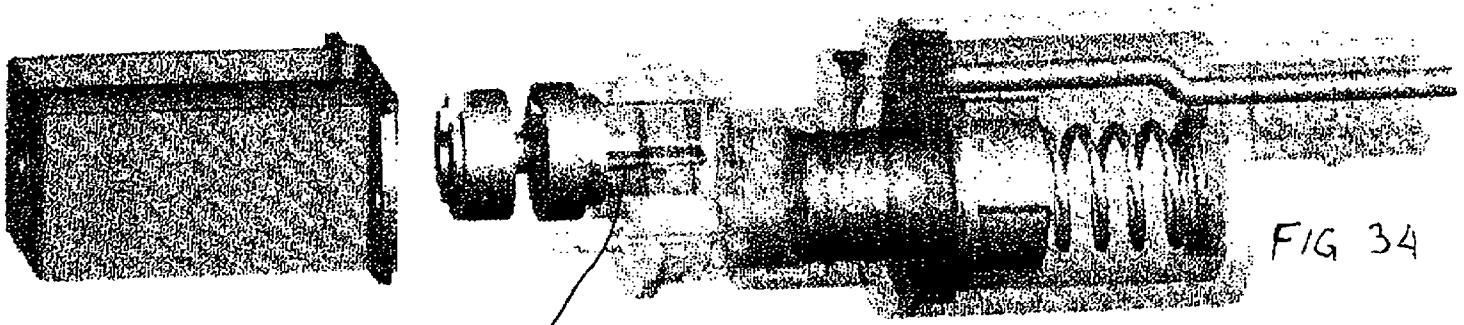

FIG. 34—is a transparent view to show the detail of the plunger 60 having an + cross section to allow air to flow past but also align the plunger and valve seat 62. This view clarifies details of the various components.

Figure 35:
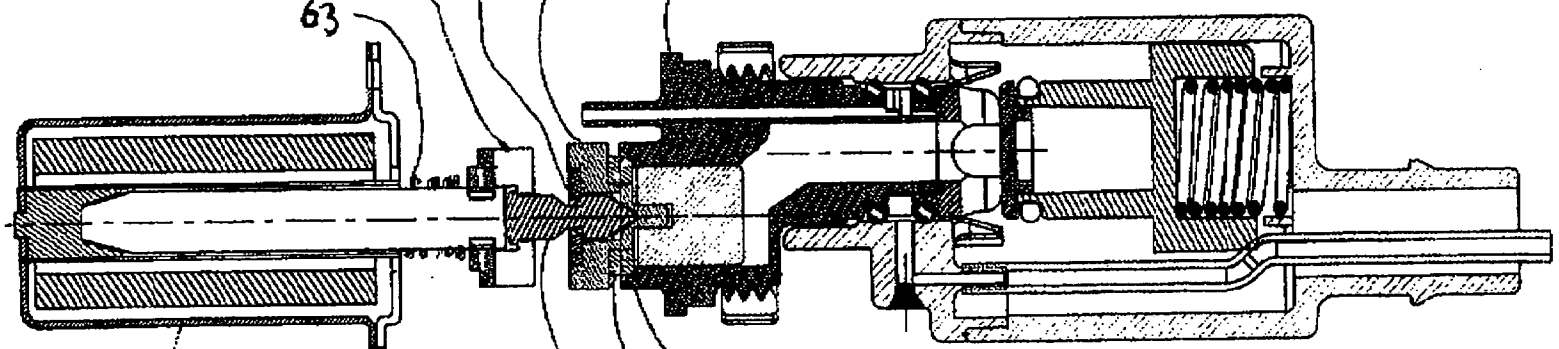

FIG. 35—is a view of the valve solenoid coil 55, which pulls solenoid rod 56 when powered to open valve compressing valve spring 63 by pulling on solenoid coupling 57 which pulls on alignment coupling 58 against plunger washer 59 which is glued to plunger 60. The plunger 60 aligns the square o-ring 61, which seals against the beveled valve seat 62 of the pump connection 1. The cornered edge of the square o-ring 61 forms a hermetically sensitive low pressure seal when pressed against the beveled valve seat 62. The parts of the valve, especially the alignment coupling, have clearance in them to allow the plunger to align the square o-ring 61 with the valve seat 62

Figure 36:
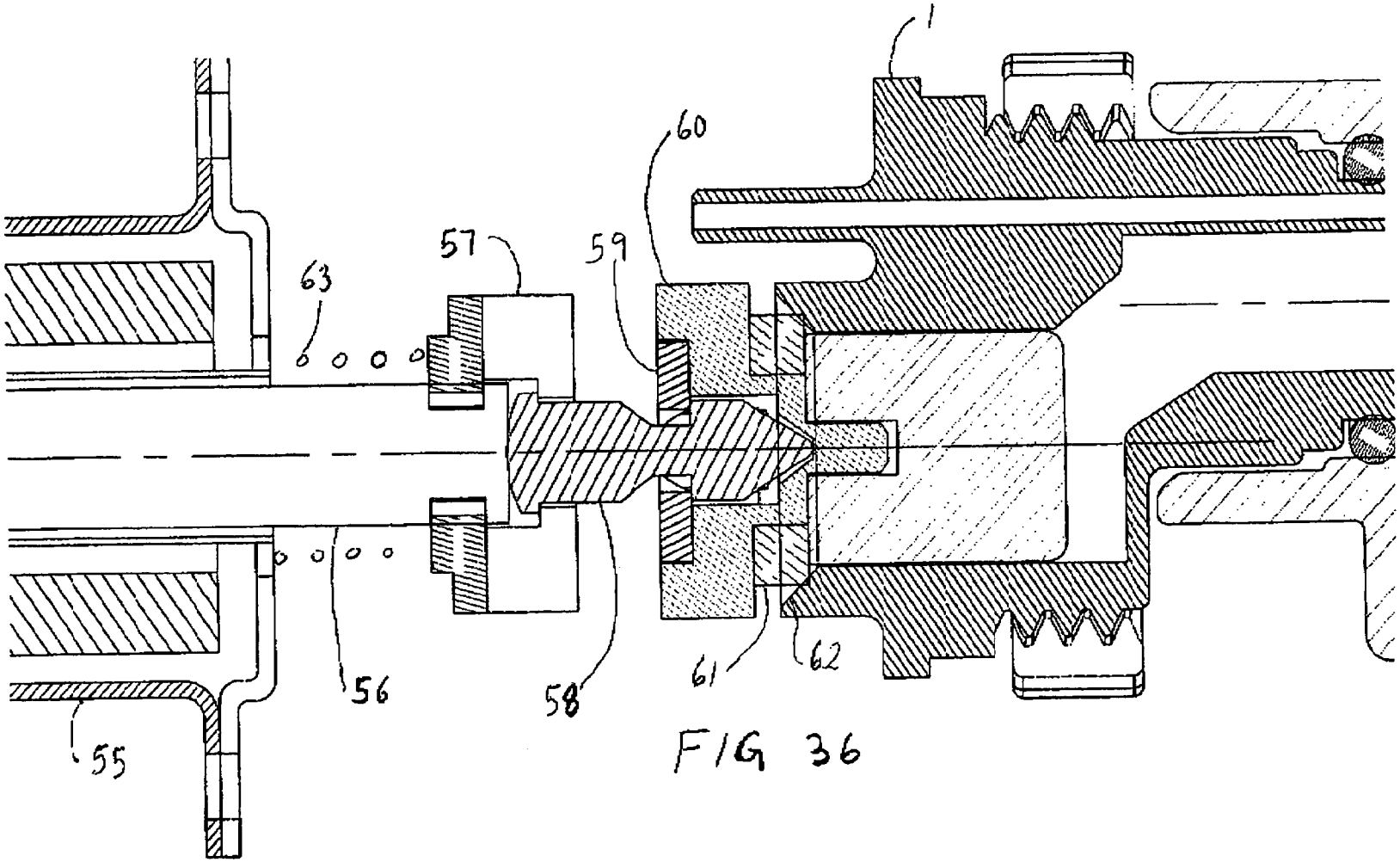

FIG. 36—is an enlargement of the valve of FIG. 35

Figure 37:
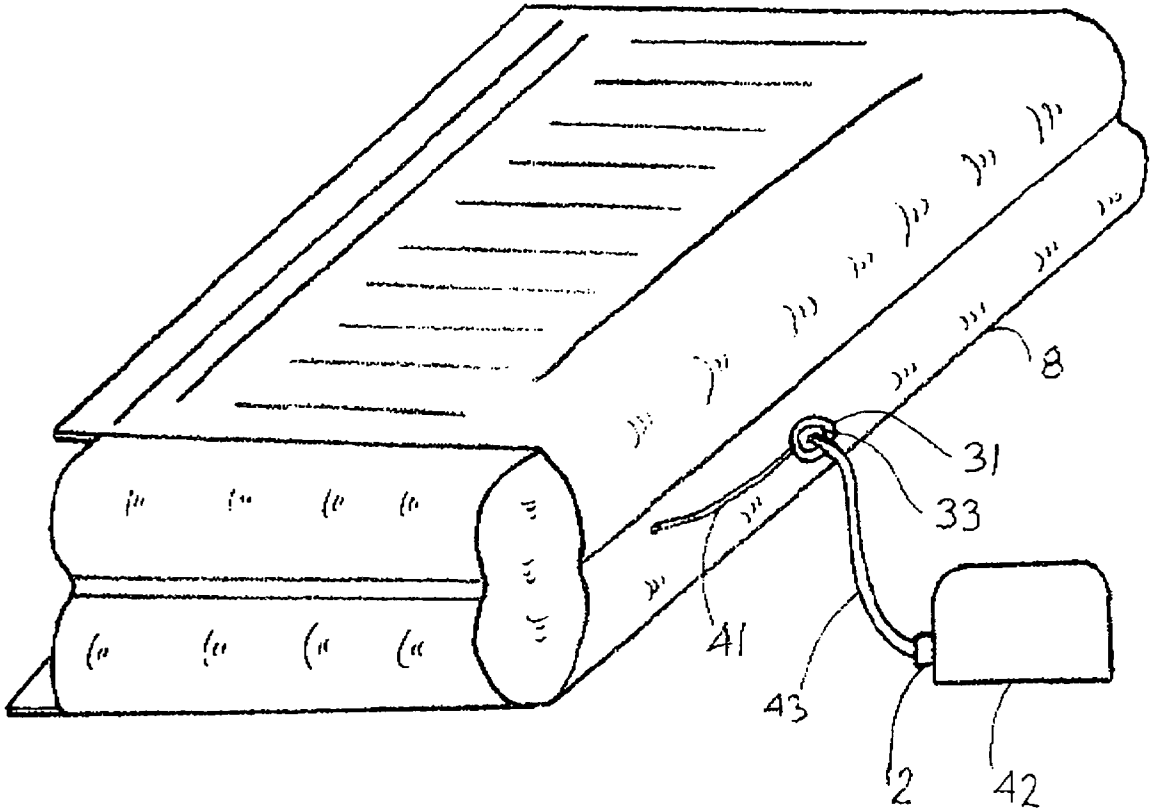
FIG. 37 is an assembly view of the pump and pressure sensor line in the air core

FIG. 37 is an assembly view of the pump 42 having hose connector with pressure sensor line 2 connected to it. The pressure sensor line 41 is located inside of air hose 43 which is connected to swivel mattress connector 33 which is secured to mattress port 31. The pressure sensor line 41 protrudes into the air core 8 to allow a pressure reading of the inside of the air core 8 to reach the pressure sensor in the pump 42.

Operation

The tooling that will that is used to perform the final closing lap weld is designed to be small enough to be removed through the mattress port. Other tooling can be removed through larger seams prior to welding them.

shows the side by side position from either the head or foot view of the mattress with a foam layer 53 on top of the air cores and cover 44 assembled over mattress components for a double air core. The cover is pulled over the components and then the perimeter fastener 48 of the lower perimeter 45 is secured. The perimeter zipper 51 is closed to secure the mattress.

FIG. 21 shows a non swivel mattress connector 30 sectional view that is threaded onto mattress port thread 26 of the mattress port 31. The flange of the port is welded to the outer surface 8 and may be pulled outward to extend past the surface of the mattress for threading. The non swivel mattress connector 30 is rotated clockwise on mattress connector thread to attach until washer 28 will be compressed to seal against the rim of the mattress port 31 at the same time pushing valve stem 22 inward (downward) opening the disconnect valve which is seated inside the body of the mattress port 31, giving the walls and rim of 31 radial structural support.

FIG. 24—is a sectional view of a mattress disconnect valve which seats in the mattress port 31. The disconnect valve housing 20 is seated inside the body of the mattress port 31, giving the walls and rim of 31 radial structural support. The spring 25 push the disconnect valve plate 21 against the disconnect valve seal 23 when the non swivel mattress connector 30 is removed. When the 30 is threaded on to the mattress port thread 26, the washer 28 pushes the disconnect valve stem 22 inward and opens the valve. FIG. 26—shows hose connector with pressure sensor line 2 secured to pump connection 1. The spring 25 is compressed allowing the disconnect plug 6 to become unseated opening the main airway as well as the pressure sensor airway. The twist lock projection 38 holds and locks the hose connector 2 to the pump after pushed, twisted, and when released, it is locked by twist lock slot 37.

FIG. 30—shows a air bed cover 44 with a lower perimeter 45 which is used to form a grip edge for the cover to hold it in place. A perimeter release 46 allows the inner edge of the lower perimeter 45 to be opened for ease of assembly so that the lower perimeter can slip over the mattress components such as the foam edge rails and air mattress, and then be secured by perimeter button 47. After secured the perimeter zipper 51 can be easily zipped closed.

REFERENCE NUMERALS IN DRAWINGS

1. pump connection
2. hose connector with pressure sensor line
3. pump connector nut
4. pump connector pressure line hose barb
5. hose connection pressure line hose barb
6. disconnect plug
7. reinforced edge beam
8. top and bottom outer surface
9. top and bottom outer surface end tab
10. reinforced squaring beam
11. non-reinforced heavy gauge vinyl corner
12*a*. non-reinforced heavy gauge vinyl patch.
12*b*. double sided reinforced vinyl
13. reinforced vinyl corner
14. reinforced vinyl seam patch
15. bottom outer surface end tab
16. thread stitching
17. reinforced vinyl flange
18. low cost fabric beam
19. low cost fabric squaring beam
20. disconnect valve housing
21. disconnect valve plate
22. disconnect valve stem
23. disconnect valve seal
24. valve screw
25. spring
26. mattress port thread
27. mattress connector thread
28. washer
29. hose barb
30. non-swivel mattress connector
31. mattress port
32. swivel mattress connector shank
33. swivel mattress connector
34. mattress port insert
35. o-ring
36. pressure sensor airway
37. twist lock slot
38. twist lock projection
39. disconnect seal
40. flap
41. pressure sensor line (or small diameter hose)
42. air pump
43. air hose
44. air bed cover
45. lower perimeter
46. perimeter release

47. perimeter button
48. perimeter fastener
49. release zipper
50. elastic material
51. perimeter zipper
52. foam edge support
53. foam pad
54. lower cover
55. valve solenoid coil
56. solenoid rod
57. solenoid coupling
58 alignment coupling
59. plunger washer
60. plunger
61 square o-ring
62. beveled valve seat
63. valve spring

CONCLUSIONS, RAMIFICATIONS AND SCOPE

To fully realize the advantage of the stronger reinforced material rather than the limitation of the butt weld burst strength an increase in ultimate burst pressure from 3 p.s.i. (pound per square inch) to 9 p.s.i. for the same material, the applicant has shown a novel method for producing not only a high quality air mattress but a method for achieving rigid inflatable objects. This method will open up new products such inflatable docks, toys, hang gliders etc., now that structural strength in terms of rigidity and hardness can be obtained using a relatively low cost method and material as compared to say rubber raft construction.

The applicant takes a novel approach by sewing through the outer hermetic surface and the patching the sewn area allowing use of a low cost fabric for I-beams and squaring beams to be sewn instead of butt welded reinforced vinyl, while at the same time producing a stronger attachment, flatter surface and reducing material costs.

Vinyl flanges, reinforced vinyl flanges and sewn flanges of I-beams double the welded area and directs the tensile force of now 2 welds in shear or lap configuration rather than the single perpendicular peeling force of a single butt weld.

The dynamic pressure measurement during pumping to obtain a preset pressure is achieved by running a separate pressure line inside the feed line, reducing the assembly complication and without having a separate mattress port and hose connections.

A high quality air bed that is easy to assemble is produced having significant and novel improvements such as to the cover, by adding perimeter relief fastener, and such as easy to use disconnects that do not protrude The union patch or thick non-reinforced vinyl patch for sealing 3 intersecting edges of reinforced vinyl solves is a novel way to eliminate butt welds in reinforced vinyl mattresses and also allow for flaps or continuous tops and bottoms of outer covers.

Accordingly, the reader will see that the features of this reinforced vinyl air mattress invention utilizes the strength of reinforced vinyl by eliminating butt seams and using novel I-beam construction methods can also be used in any inflatable product. Thus the scope of the invention should be determined by the appended claims and their legal equivalents, rather than by the examples given.

I claim:

1. An inflatable mattress comprising; an air bladder, a pressure sensor line, a pressure sensor, an air pump, a mattress port, and an air hose, having said mattress port sealed to said air bladder and having said air hose connected to said mattress port and at one end, and connected to said air pump, forming a pump connection, at other end of said air hose, wherein; one end of said pressure sensor line is connected to said pressure sensor and said pressure sensor line is routed through said formed pump connection and into and through internal wall of said air hose and extending through said air hose connected to said air mattress and through said mattress port into said mattress whereby said pressure sensor reads the air pressure within said mattress while pumping.

2. The inflatable mattress of claim 1 further comprising; a thin walled extendable connection port having said port welded to surface of said air bladder, an insert and a port connector having end of said air hose attached wherein; said insert is placed in said thin walled connection port and said port connector secures said port connector with attached said air hose to said thin walled connection port whereby said thin walled port can be retracted flush with said air bladder surface and whereby said air hose can be positioned along outer surface of said air bladder.

* * * * *